United States Patent [19]

Ray et al.

[11] Patent Number: 4,741,454

[45] Date of Patent: May 3, 1988

[54] PROTECTIVE ENCLOSURE FOR VENDING APPARATUS AND THE LIKE

[75] Inventors: John S. Ray, 4008 NW. Highway 67, Sedalia, Colo. 80135; Larry H. Ellis, Colorado Springs, Colo.

[73] Assignee: John S. Ray, Sedalia, Colo.

[21] Appl. No.: 819,796

[22] Filed: Jan. 16, 1986

[51] Int. Cl.[4] ..... B65D 45/00

[52] U.S. Cl. ..... 220/315; 70/78; 292/259

[58] Field of Search ..... 206/1.5; 220/210, 315, 220/323; 292/259; 70/78, 86, DIG. 64; 312/216; 16/388

[56] References Cited

U.S. PATENT DOCUMENTS

| | | | |
|---|---|---|---|
| 2,875,918 | 3/1959 | Baumier | 220/323 |
| 3,665,736 | 5/1972 | Wilson | 70/78 |
| 3,806,179 | 4/1974 | Roessle | 292/259 |
| 3,821,884 | 7/1974 | Walsh | 292/259 |
| 4,106,661 | 8/1978 | Hunt | 220/315 |
| 4,135,375 | 1/1979 | Voegeli | 70/78 |
| 4,330,147 | 5/1982 | Nolen | 292/259 |
| 4,418,551 | 12/1983 | Kochackis | 70/78 |
| 4,452,371 | 6/1984 | Jurek | 220/315 |
| 4,477,130 | 10/1984 | Frantz | 16/388 |
| 4,491,354 | 1/1985 | Williams | 292/259 R |

FOREIGN PATENT DOCUMENTS

| | | | |
|---|---|---|---|
| 366024 | 12/1922 | Fed. Rep. of Germany | 292/259 |
| 1099900 | 2/1961 | Fed. Rep. of Germany | 16/388 |
| 2270425 | 12/1975 | France | 16/388 |

*Primary Examiner*—David F. Fidei
*Attorney, Agent, or Firm*—Timothy J. Martin

[57] ABSTRACT

A protective enclosure for vending apparatus includes a housing and door structure having a locking assembly therefor. The door has a peripheral channel, and an elongated sleeve is attached to the door so that opposite ears on the sleeve are positioned in the channel. A latch bar is inserted through the housing and the sleeve to prevent opening of the door, and a keyed lock mechanism, which is mounted entirely within the enclosure, has a locking element that lockably engages the latch bar. Fingers may be provided on the door which fingers engage slots in the housing to prevent removal of the door by breaching the hinge. Adjustable spacers on the sleeve interact with the latch bar to firmly seat the door when the latch bar is inserted into the sleeve.

19 Claims, 2 Drawing Sheets

PROTECTIVE ENCLOSURE FOR VENDING APPARATUS AND THE LIKE

BACKGROUND OF THE INVENTION

The present invention relates to protective enclosures which may be locked to protect contents stored or mounted in the enclosure. Accordingly, the present invention is particularly adapted for containing vending apparatus so as to protect deposited money against theft and to protect the vending apparatus against vandalism or other physical damage. Of specific interest to the present invention is the protection of air dispensing apparatus wherein air pressure is provided to a dispensing hose for a timed interval determined by the vending apparatus.

Throughout history, there has been an ever increasing need for safe storage containers that secure valuables and the like. The need for secure storage containers is particularly keen where those storage containers are located in isolated areas that are nonetheless accessible by the public. Vending machines in the form of a secure housing and a vending mechanism comprise one area of this need. Despite the fact that vending apparatus do not typically contain unusually large sums of money, there is still the propensity for various individuals to attempt the robbery. In order to be cost efficient however, the protective enclosure for vending apparatus must, itself, be relatively inexpensive yet resistant against vandalism.

This need to provide secure enclosures for vending apparatus has been recognized in the past, and has also been recognized for the specific application of vended pressurized air. One such prior art device describing tamper-resistant housing is shown in U.S. Pat. No. 4,452,371 issued June 5, 1984 to Jurek. This disclosure describes a device having a formed enclosure complete with a hinged door. The door includes a pair of metal loops formed on its interior so that, when closed, a locking bar may be vertically positioned through a pair of slots in the enclosure to be mateably received through the loops. The locking bar has a first angled end to prevent its passage complete through the enclosure and a hole is formed in the opposite end which receives the shackle of a padlock. A recessed housing portion is sized to physically receive the padlock and to limit the access thereto. A similar protective enclosure and lock housing was earlier developed on a protective enclosure sold by the assignee of the present applicant. In this prior device, a padlock was protected by providing an external cylindrical shield that surrounded the padlock.

Despite the protective features provided by the housing described in the Jurek patent and in the housing earlier developed by the present assignee, these protective enclosures were still somewhat receptive to vandalism. For example, a vandal could still obtain enough leveraged access to a lock so as to distort the housing a sufficient degree to remove the lock with a bolt cutter. Further, these prior art enclosures allowed direct access to the locking bar so that entry could be attempted by destroying the hook on the locking bar and sliding the bar completely through the enclosure. Even greater susceptibility to the integrity of these enclosures resulted from the ability of a vandal to break the metal loops off of the hinged door by prying the door away from the locking bar or by drilling the hinge so that the enclosure could be open from the hinged side of the locking bar and metal receiving loops were intact. Further, the top, bottom or sides of these boxes could be distorted by a pry bar so as to allow manual entry into the enclosure.

Accordingly, the present invention is directed to providing a protective enclosure that greatly reduces the susceptibility of the enclosure to vandalism through either an attack on the locking bar, the hinge or the lock or by the distorting of the enclosure by prying against its surrounding side walls or door frame structure. Thus, the present invention provides specific advantages over the prior art structures by increasing the security of the contents of the enclosure by reducing the ease, and therefore the likelihood, of vandalism.

SUMMARY OF THE INVENTION

It is an object of the present invention to provide a relatively inexpensive protective enclosure that has substantial structural strength and that may be produced at relatively low cost.

It is another object of the present invention to provide a protective enclosure that is useful to hold apparatus, such as vending apparatus, against vandalism wherein access to the locking elements is severely restricted.

It is a further object of the present invention to provide a protective enclosure incorporating mechanical safeguards that reduce the likelihood of unauthorized entry into the enclosure even where a vandal breaches some of the enclosure's security features.

It is a still further object of the present invention to provide a protective enclosure that deters vandalism by increasing the difficulty of unauthorized entry into the enclosure to such a time consuming task so as to deter attempted vandalism yet which enclosure may be readily and easily accessed by authorized personnel.

In its broad form, the present invention provides a protective enclosure in the form of a box-like housing structure having a back wall and a surrounding side wall to define an interior adapted to receive various equipment, such as vending apparatus. This housing structure has an open front access area that may be selectively opened and closed by means of a door panel mounted thereon. Preferably, the door panel is secured along a first edge portion by means of a hinge and finger structure so that, when closed, a plurality of fingers are received by mating slots in the housing structure so that, even by removal of the hinge, the door panel may not be removed. An opposite edge of the door panel may be selectively locked to the housing structure by means of an elongated sleeve mounted on an inside surface of the door with this sleeve positioned to receive a latch bar. This latch bar is inserted through a lower bar opening and passes upwardly through the elongated sleeve when the door panel is closed. The latch bar is sized so that its leading end contacts a top wall portion of the surrounding sidewall with its trailing end flush with a bottom wall portion of the sidewall. In this position, the opposite ends of the latch bar abut the interior of the housing to prevent outward opening of the door. The latch bar is releasably locked into place by means of a locking mechanism mounted completely within the housing interior. The lock mechanism operates a lock element that is movable into locking engagement with the latch bar. Key access to the lock mechanism is through a single small key opening in the housing so that a vandal's access to the locking mechanism is virtually impossible yet whereby a key may be inserted by an authorized person for easy operation of the locking element.

In the preferred form of the present invention, the front access opening has a surrounding shoulder assembly fabricated integrally with the housing, which shoulder assembly provides a seat for an inwardly turned lip on the door panel. The elongated sleeve includes a pair of oppositely projecting ears that extend into a channel defined by the lip so that, when the locking bar is received in the sleeve, the ears prevent separation of the sleeve from the door panel even should physical deattachment of the sleeve and the door panel occur. Further, the sleeve is provided with adjustable spacers so that insertion of the latch bar through the sleeve actually draws the door panel towards the back panel of the enclosure to help seat the door panel lip against the surrounding shoulder of the access opening. This close fitting and tight nesting of the door panel within the access opening further reduces the ability for a vandal to pry the door panel or side walls of the protective enclosure.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to providing a protective enclosure that is specifically adapted for receiving equipment, especially vending apparatus, so as to protect the apparatus against vandalism. Thus, while the protective enclosure is described with respect to vending apparatus, it should be fully appreciated that the structure described in this invention could be applied in other situations where a relatively secure, protective enclosure is desired.

Figure 1:
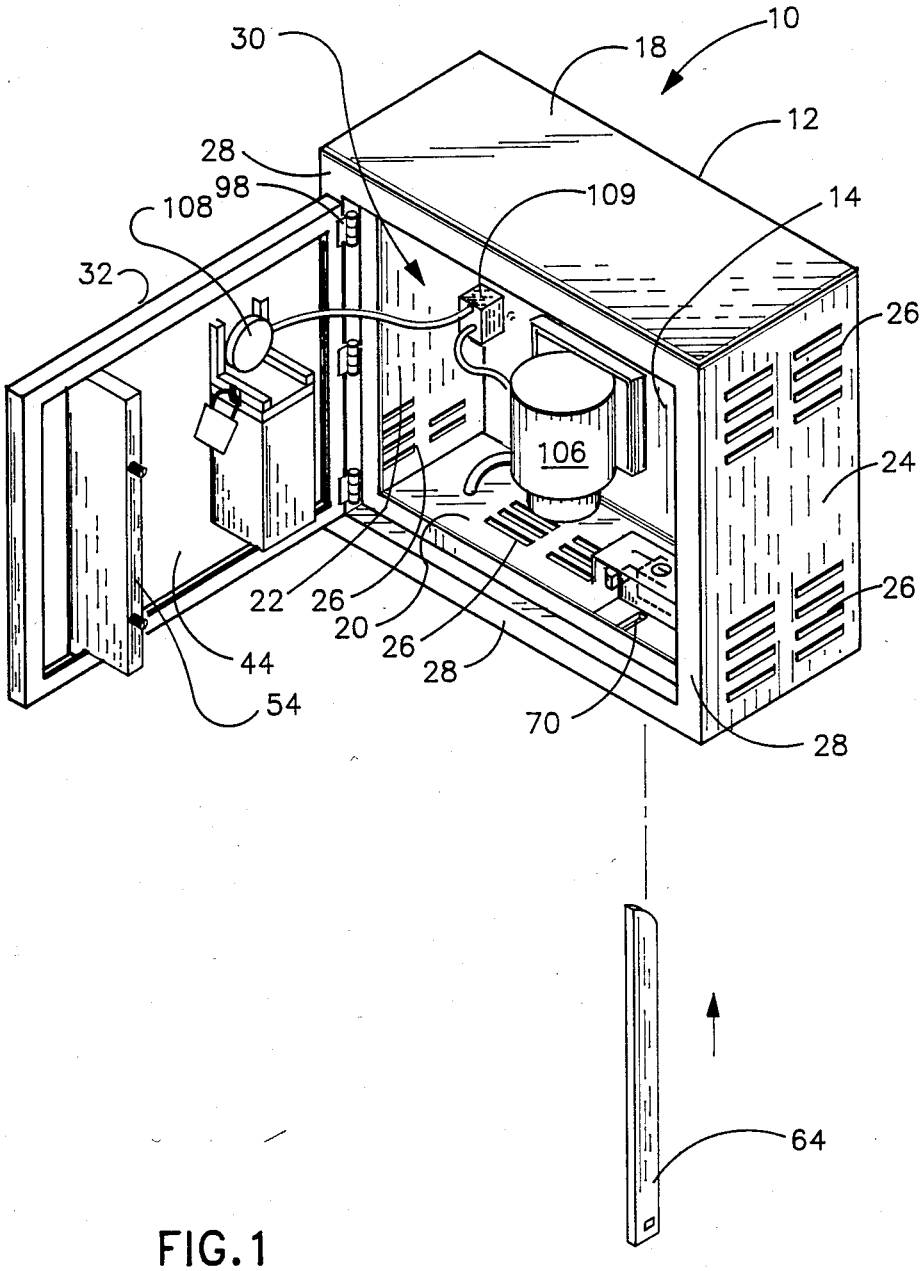
FIG. 1 is a perspective view of the protective enclosure according to the preferred embodiment of the present invention shown with its door in the open position.

As is shown in FIG. 1, the protective enclosure 10 has a box-like housing structure 12 formed by a back wall 14 and a surrounding side wall to define a generally open interior 16. The surrounding side wall for housing structure 12 is defined by a top wall 18, a bottom wall 20 and first and second end walls 22 and 24. Suitable vending ventilation louvers slits 26 can be provided, if desired, in the surrounding side wall. Annular front wall 28 extends around the front of housing structure 12 on the surrounding side wall to define an access opening 30 into the interior 16 of protective enclosure 10. In order to completely enclose housing structure 12, a door 32 is secured along a first edge portion 34 by means of a hinge 36 so that door 32 may be pivotally moved between an open position for accessing interior 16 and a closed position when the door 32 is positioned across the access opening 30.

Figure 2:
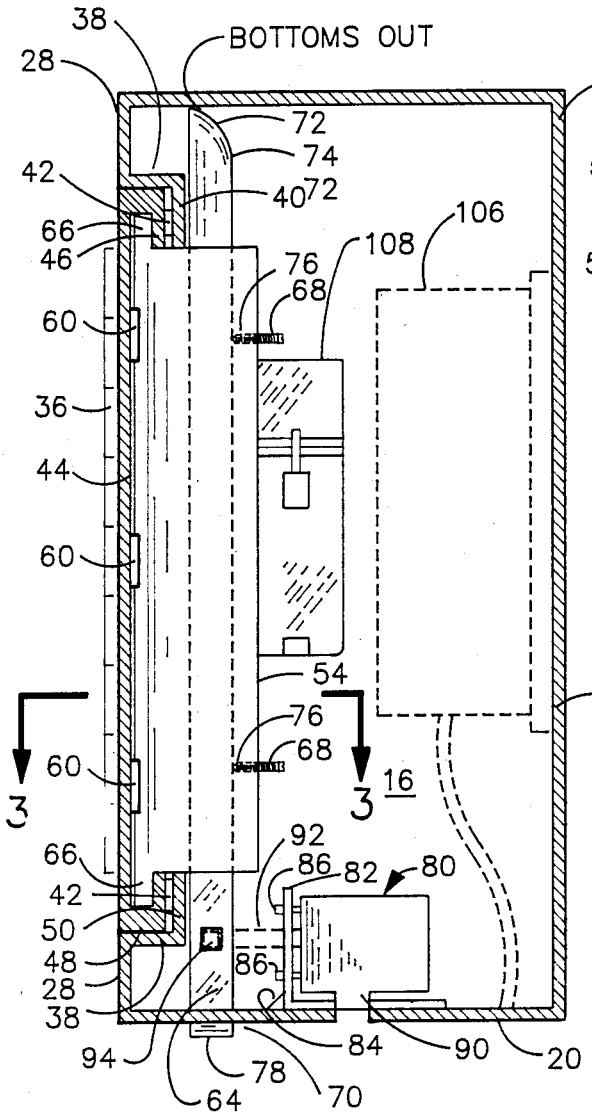
FIG. 2 is a cross-sectioned view of the protective enclosure of FIG. 1 with its door in the closed position.

The mounting structure for door 32 and the structure of the latching means for releasably securring door 32 in the closed positon is seen in greatest detail in FIG. 2. As is shown in this figure, annular front wall 28 has an inwardly projecting angular shoulder 38 that defines a seating surface 40 that is recessed inwardly of annular front panel 28. A gasket 42 may be mounted in a convenient manner, such as by an adhesive, on seating surface 40 in order to provide a seal between seating surface 40 and the edge of door 32. As is seen in FIG. 2, door 32 has a main panel 44 having an inwardly turned lip 46 around its peripheral edge. Lip 46 is formed by a bottom web 48 and a side web 50 to define a channel 52 which extends around the peripheral edge of door 32, and door 32 is dimensioned for close fitting orientation within the access opening 30 so that an interior surface of side web 50 seats against seating surface 40 of shoulder 38. Thus, side web 50 may compress gasket 42 to provide a relatively water-tight seal for door 32 with respect to housing structure 12. Furthermore, lip 46 is sized so that main panel 44 is substantially coplanar with annular front wall 28 thereby making the front surface of housing structure 12 relatively flush.

Figure 3:
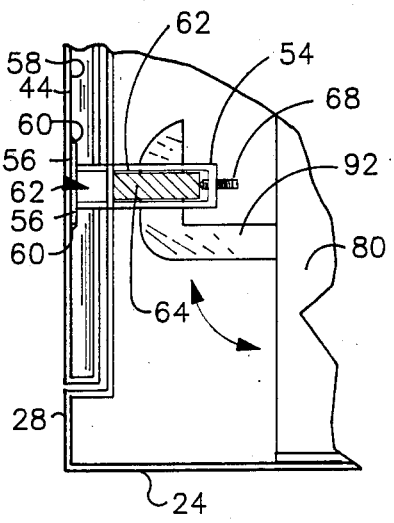
FIG. 3 is a cross-sectional view taken about line 3—3 of FIG. 2.

In order to releasably secure door 32 in the closed position wherein it is retained across the front area of or access area 30 of housing structure 12, a latching means is provided which latching means includes several features providing advantages over the prior art. Specifically, as is shown in FIGS. 2 and 3, an elongated sleeve 54 is securely attached to an interior surface 58 of main panel 44 by means of weldments 60 on mounting wings 56 of sleeve 54, Thus, sleeve 54 is a channel-shaped structure that defines an elongated passageway 62 for telescopically receiving a latch bar 64 as is described more thoroughly below. The edge portion of sleeve 54 adjacent interior surface 58 has oppositely projecting ears 66 that extend into channel 52. Adjustment screws 68 pass through the wall of sleeve 54 to project into passageway 62 and provide adjustable spacer means for selectively adjusting and directing the positioning of latch bar 64 therein.

As is seen in FIGS. 2 and 3, a bar opening 70 is provided in bottom wall 20 with bar opening 70 being sized to allow the insertion of latch bar 64 therethrough. When door 32 is in the closed position, sleeve 54 is positioned over bar opening 70 so that, as latch bar is passed through bar opening 70, it enters and passes through elongated passageway 62 in sleeve 54. Bar opening 70 is spaced from front wall 28 a distance equal to the recessed distance of angular shoulder 38 from front wall 28 so that the inwardly turned shoulder portion of angle shoulder 38, along with bar opening 70, acts to guide bar 66 as it telescopes through sleeve 54. Further, as is seen in FIG. 2, once bar 64 passes through sleeve 54, it abuts shoulder 38 on opposite sides of door 32 to prevent the opening of door 32 when bar 64 is in this latched position. Adjustment screws 68 abut an edge of latch bar 64 so that, by adjusting screws 68 for a selected amount of extension into passageway 62, the tightness of the seating relationship between side web 50 and seating surface 40 may be selectively adjusted. In order to avoid the jammimg of latch bar 64 against screw 68 as it is inserted through sleeve 54, the forward end 72 of latch bar 64 has a sloping edge 74 to facilitate movement within 72 past adjustment screws 68. To this end, also, the leading ends 76 of screws 68 are each tapered to cooperate with sloping edge 74 to facilitate movement of latch bar 64 therepast. Further, it should be appreciated that the length of latch bar 64 is selected so that it may be completely inserted into enclosure 10 with its leading or forward end 72 contacts top wall 18 just as its trailing end 78 becomes substantially flush with bottom wall 20, as is shown in FIG. 2. This sizing prevents complete entry of latch bar 64 into interior 16 yet denies easy access to the trailing end 78.

In order to releasably lock latch bar 64 in the latched position so that door 32 may not be opened by unauthorized personnel, a locking mechanism 80 is provided. As is shown in FIGS. 2 and 3, lock mechanism 80 is mounted on the interior of protective enclosure 10 and is secured to bottom wall 20 by means of a mounting bracket 82 that is welded by weldments 84 directly to bottom wall 20. A pair of screws 86 secure lock 80 to bracket 82 so that it is securely mounted onto bottom wall 20. A key opening 88 is formed in bottom wall 20 so that a key may be inserted into key cylinder 90 through opening 88. Bracket 82 has a cylinder opening 85 that is sized to matably receive key cylinder 90 so that the exposed surface of key cylinder 90 is flush with bracket 82 against the interior surface of bottom wall 20. It should be observed that no portion of lock mechanism 80 protrudes from protective enclosure 10 so that it is inaccessible from the exterior. A vandal is thus prevented from "wrenching" the lock mechanism by groping the key cylinder 90 with pliers.

As is known in the art, key cylinder 90, when rotated by the lock key (not shown) rotates to pivot latch bolt 92 which, in the preferred embodiment, is an L-shaped latching element that pivots into and out of a latch opening 94 formed in latch bar 64. It should thus be appreciated that, when latch bar 64 is inserted through sleeve 54 so that leading end 72 contacts top wall 18 and trailing end 78 is flush with bottom wall 20, latch opening 94 is positioned for engagement with latch bolt 92 when locking mechanism 80 is operated. Once latch bolt 92 engages latch opening 94, latch bar 64 may not be removed from sleeve 54. Thus, door 32 is securely locked into position on housing structure 12.

Figure 4:
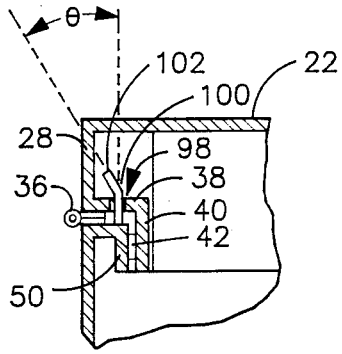
FIG. 4 is a view in partial cross-section of the door, hinge and finger securing elements according to the preferred embodiment of the present invention.

In order to further enhance the integrity of door 32 against any vandal who may seek to attack hinge 36, a further protective structure is provided along a portion of shoulder 38 adjacent hinge 36. As is shown in FIGS. 1 and 4, shoulder portion 96 between seating surface 40 and front wall 28 is provided with a plurality of slots 98 which are positioned to receive corresponding fingers 100 that are welded on the outer surface of bottom web 48 of lip 46. Each of fingers 100 projects laterally away from web 48 and generally perpendicularly thereto but terminates in an angled tip 102 formed at an acute angle of approximately 30° with respect to base 104 of finger 100. This angle tip allows for the angular movement of finger 100 through slot 98 along the radius between finger portion 104 and hinge 36 since finger 100 follows the circumfrence of a circle. Alternately, each finger 100 could be formed as an arcuate member that passes through each slot 98. It should be appreciated that, by providing this additional securing means, door 32 may not be removed from protective enclosure 10 once latch bar 64 is locked into position even in the event that hinge 36 is broken. Should hinge 36 be broken by a vandal, or should the hinge pin be removed, fingers 100 will prevent removal of door 32 from its seated engagement in access opening 30. It should further be appreciated, that by providing ears 66 on sleeve 54, any success of a vandal in breaking the weldments 60 to detach sleeve 54 from door 32 will be thwarted since ears 66 will prevent separation of sleeve 54 from door 32 once latch bar 64 is in position even in the event that sleeve 54 becomes physically detached from main panel 44.

It should thus be appreciated that the present invention may be utilized to hold any convenient vending mechanism, such as an air pump 106 the operation of which is controlled by coin operated timing mechanism 108 through switch 109. In use, the desired apparatus may be mounted in the interior 16 of protective enclosure 10 after which door 32 is pivoted into position so that fingers 100 mate with slots 98 and so that elongated passageway 62 is aligned with bar opening 70. Latch bar 64 is then inserted through opening 70 and into passageway 62. As this insertion takes place, latch bar 64 will contact screws 68 to draw main panel 44 toward back panel 14 thereby firmly seating side web 50 of door 32 onto seating surface 40 of shoulder 38. Bar 64 is then passed through sleeve 54 until forward and 72 contacts top wall 18 so that trailing end 78 is flush with bottom wall 20. The forward edge of bar 64 abuts the interior surface of shoulder 38 on opposite sides of door 32 to prevent the opening of door 32. Latch bar 64 is then locked into position by operating lock mechansim 80 to engage latch bolt 92 of lock 80 with latch opening 94 of latch bar 64.

Accordingly, the present invention has been described with some degree of particularity directed to the preferred embodiment of the present invention. it should be appreciated, though, that the present invention is defined by the following claims construed in light of the prior art so that modifications or changes may be made to the preferred embodiment of the present invention without departing from the inventive concepts contained herein.

We claim:

1. A protective enclosure having a generally open interior adapted to receive and mount vending apparatus to resist unauthorized access and vandalism thereto and to otherwise protect the vending apparatus comprising:

a box-like housing structure having a back wall panel and surrounding sidewalls to define said interior, said housing structure having an open front area for allowing access into the interior thereof;

a door panel adapted to selectively and completely enclose said interior by being positioned and retained across said front area to define a closed position;

securing means for securing a first edge portion of said door panel to said housing structure;

latching means cooperating with said securing means for releaseably latching said door panel in a closed position to prevent access to the interior, said latching means including an elongated sleeve attached to said door panel adjacent a second edge portion thereof and projecting into the interior when the door panel is in the closed position, said elongated sleeve extending across said door panel from a third side edge to a fourth and opposite side edge and having retaining means on each end thereof for mechanically retaining said sleeve and said door panel together in the event that said sleeve becomes detached from said door panel while said latch bar is engaged therewith, said latching means including a latch bar insertable through a slot in one of said sidewalls and into telescopic engagement with said sleeve whereby said door panel cannot be removed from said front area when said latch bar is engaged with said sleeve; and a keyed lock mechanism mounted to said housing structure on the interIor thereof and having a locking element moveable between a locked state wherein the locking element locks said latch bar in engagement with said sleeve and an unlocked state releasing said latch bar for withdrawal from said sleeve, said housing structure having a key opening immediately adjacent said lock mechanism whereby a key may be inserted through said key opening into said lock mechanism to permit manipulation of the locking element.

2. A protective enclosure according to claim 1 wherein said retaining means for said sleeve includes a pair of oppositely projecting ears on each end of said sleeve, said door panel including inwardly turned lip portions dimensioned to prevent said door panel from being removed from said front area when said latch bar is engaged with said sleeve in the event that said sleeve becomes detached from said door panel.

3. A protective enclosure according to claim 1 including adjustable spacer means in said sleeve for laterally adjusting the position of said latch bar therein whereby the act of inserting said latch bar into said sleeve causes said door panel to be drawn toward said back panel.

4. A protective enclosure according to claim 1 wherein said securing means includes a hinge pivotally attaching said door panel to said housing structure along said first edge portion whereby said door panel is pivotally moved into said closed position at least oen finger projecting outwardly from said first edge portion, said finger being moved into engagement with said housing structure when said door panel is pivoted into the closed position to prevent removal of said door panel when said latch bar is engaged with said sleeve in the event that said hinge is detached.

5. A protective enclosure having a generally open interior adapted to receive and mount vending apparatus to resist unauthorized access and vanalism thereto and to otherwise protect the vending apparatus, comprising:

a box-like housing structure having a back panel, surrounding sidewall panels and an annular front panel defining an access opening for allowing access to the interior of said housing structure, said front panel having an inwardly projecting shoulder along its interior perimeter to define a seating surface;

a door dimensioned for close fitting orientation within said access opening, said door panel including a main panel and an inwardly turned lip forming a channel around the peripheral edge of the door, said channel having a bottom web defining the perimeter of the door and a side web extending in spaced relation to said main panel;

hinge means for pivotally attaching a first peripheral edge portion of said door to a first portion of said annular front whereby said door may be moved between an open position for accessing said interior and a closed position wherein said door is positioned in said access opening with said channel sidewall seated against said shoulder seating surface;

an elongated sleeve attached to said door on an interior surface thereof in spaced relation to said hinge means, said sleeve having oppositely projecting ears each extending into said channel;

a latch bar adapted to be inserted through a bar opening in a first one of said sidewalls, said sleeve oriented to receive said latch bar when the door is in the closed position whereby said door cannot be opened when the latch bar engages said sleeve; and a keyed lock mechanism mounted to said housing on the interior thereof and having a locking element moveable between a locked state wherein the locking element locks said latch bar in engagement with said sleeve and an unlocked state releasing said latch bar for from said sleeve, said housing structure having a key opening immediately adjacent said lock mechanism whereby a key may be inserted through said key opening into said lock mechanism to permit manipulation of the locking element.

6. A protective enclosure according to claim 5 including a gasket mounted on said seating surface to provide a water-tight seal between said door and said shoulder.

7. A protective enclosure according to claim 5 including adjustable spacer means in said sleeve for laterally adjusting the position of said latch bar therein whereby the act of inserting said latch bar into said sleeve causes said door panel to be drawn toward said back panel.

8. A protective enclosure according to claim 7 wherein said spacer means includes at least two screws threadably received in said sleeve and having leading ends extending into the interior of said sleeve to abut said latch bar therein, said leading ends each being tapered.

9. A protective enclosure according to claim 8 where said latch bar has a forward end for insertion through said bar opening into said sleeve, said forward end having a sloping edge adapted to impact the tapered leading edges of said screws to facilitate guided movement therealong.

10. A protective enclosure according to claim 5 wherein said bar opening and said sleeve are sized and positioned whereby opposite end portions of said latch bar protrude from each end of said sleeve to laterally abut an interior surface of said shoulder to latch said door in the closed position.

11. A protective enclosure according to claim 10 wherein said latch bar is sized so that its trailing end opposite said forward end is relatively flush with said first sidewall when the latch bar is in the locked state, said forward end contacting second one of said sidewalls opposite said first one of said sidewalls.

12. A protective enclosure according to claim 11 wherein said first sidewall is selected to be a horizontal bottom wall when said protective enclosure is mounted on a support surface.

13. A protective enclosure according to claim 5 including a plurality of slots formed in said shoulder adjacent said hinge and a plurality of finger elements attached to said door along said first peripheral edge portion and positioned to move into and out of respective ones of said slots when said door is closed and opened.

14. A protective enclosure according to claim 13 wherein each of said finger elements included first straight portion attached to said first peripheral edge portion and a second straight portion extending at an acute angle from said first straight portion.

15. A protective enclosure according to claim 5 wherein said lock mechanism is mounted by a bracket which extends over said key opening, said lock mechanism including a key cylinder protruding therefrom, said bracket having a cylinder opening aligned with said key opening and adapted to receive said key cylinder so that the key cylinder is flush with said housing.

16. A protective enclosure having a generally open interior adapted to receive and mount vending apparatus to resist unauthorized access and vandalism thereto and to otherwise protect the vending apparatus comprising:

a box-like housing structure having a back panel, a pair of side panels, a top panel and a bottom panel forming a surrounding sidewall that defines said interior, said housing structure having an open front area for allowing access into the interior thereof;

a door panel adapted to selectively and completely enclose said interior by being inset into and retained across said front area to define a closed position;

securing means for securing a first edge portion of said door panel to said housing structure;

latching means cooperating with said securing means for releasably latching said door panel in a closed position to prevent access to the interior, said latching means including a sleeve attached to said door panel adjacent a second edge portion thereof and projecting into the interior when the door panel is in the closed position, and including a latch bar insertable upwardly through a slot in said bottom panel and into telescopic engagement with said sleeve whereby said door panel cannot be removed from said front area when said latch bar is engaged with said sleeve, said latch bar having a forward end and a trailing end and being sized so that the trailing end is flush with said bottom panel when the latch bar is in the locked state and with said latch bar extending through said sleeve so that the forward end thereof is proximate said top panel; and a keyed lock mechanism mounted in the interior of said housing structure on said bottom panel and having a locking element movable between a locked state wherein the locking element locks said latch bar in engagement with said sleeve and an unlocked state releasing said latch bar for freefall out of said sleeve, said bottom panel having a key opening immediately adjacent said lock mechanism whereby a key may be inserted through said key opening into said lock mechanism to permit manipulation of the locking element.

17. A protective enclosure according to claim 16 wherein said sleeve includes a pair of oppositely projecting ears on each end of said sleeve, said door panel including inwardly turned lip portions dimensioned to prevent said door panel from being removed from said front area when said latch bar is engaged with said sleeve in the event that said sleeve becomes detached from said door panel.

18. A protective enclosure according to claim 17 wherein said securing means includes a hinge pivotally attaching said door panel to said housing structure along said first edge portion whereby said door panel is pivotally moved into said closed position at least one finger projecting outwardly from said first edge portion, said finger being moved into engagement with said housing structure when said door panel is pivoted into the closed position to prevent removal of said door panel when said latch bar is engaged with said sleeve in the event that said hinge is detached.

19. A protective enclosure according to claim 16 wherein said lock mechanism is mounted by a bracket which extends over said key opening, said lock mechanism including a key cylinder protruding therefrom, said bracket having a cylider opening aligned with said key opening and adapted to receive said key cylinder so that the key cylinder is flush with said housing.

* * * * *